US008766813B2

(12) United States Patent
Hsieh

(10) Patent No.: US 8,766,813 B2
(45) Date of Patent: Jul. 1, 2014

(54) QUICK-RELEASE ANGLE MEASURING DEVICE

(75) Inventor: Chih-Ching Hsieh, Taichung (TW)

(73) Assignee: Kabo Tool Company, Taichung (TW)

( * ) Notice: Subject to any disclaimer, the term of this patent is extended or adjusted under 35 U.S.C. 154(b) by 206 days.

(21) Appl. No.: 13/471,463

(22) Filed: May 15, 2012

(65) Prior Publication Data

US 2013/0176135 A1 Jul. 11, 2013

(30) Foreign Application Priority Data

Jan. 9, 2012 (TW) ..... 101100851 A

(51) Int. Cl.
*G08B 21/00* (2006.01)

(52) U.S. Cl.
USPC ..... 340/686.1; 81/479

(58) Field of Classification Search
CPC ..... B25B 23/1425; B25B 23/1427
USPC ..... 340/686.1, 691.1; 73/862.21, 862.22, 73/862.23; 81/479
See application file for complete search history.

(56) References Cited

U.S. PATENT DOCUMENTS 5,537,877 A * 7/1996 Hsu ..... 73/862.23
2012/0132043 A1 * 5/2012 Chen et al. ..... 81/479

* cited by examiner

*Primary Examiner* — Jeffery Hofsass
(74) *Attorney, Agent, or Firm* — CKC & Partners Co., Ltd.

(57) ABSTRACT

A quick-release angle measuring device is disclosed. The quick-release angle measuring device is applied to a hand tool, and includes a body, an angle sensor, a controller, a monitor and a power supply. The body has a quick-release part arranged on the body and for being detachable connected to the hand tool. The angle sensor is arranged in the body for detecting an angle value of the hand tool. The controller is arranged in the body and is signally connected to the angle sensor for a user to set a factor on the angle value. The monitor is arranged on the body and is signally connected to the controller for displaying the angle value. The power supply is arranged in the body for supplying electric power to the controller, the angle sensor and the monitor.

9 Claims, 2 Drawing Sheets

QUICK-RELEASE ANGLE MEASURING DEVICE

RELATED APPLICATIONS

This application claims priority to Taiwan Application Serial Number 101100851, filed Jan. 9, 2012, which is herein incorporated by reference.

FIELD OF THE INVENTION

The present disclosure relates to an angle measuring device, and more particularly to a quick-release angle measuring device.

BACKGROUND OF THE INVENTION

Currently, wrenches are widely used to fabricate and maintain machines by screwing or unscrewing each screw element, such as screw nuts, of the machines or components. However, in some highly precise machines, the unscrewing of each screw element requires a specific procedure and an appropriate operation angle. If a careless mistake is made in a manual operation, the screw element or a screw thread in a screw hole may be damaged, or the function and the precision of the machine are impaired.

For the aforementioned reason, some factories provide wrenches having functions of immediately detecting and displaying an angle value. Therefore, when a user exerts force to operate the wrench, the user can immediately know the real angle value of the force. However, the wrench built-in with the functions of immediately detecting and displaying the angle value limits the use and the operation, and is helpless for the user having an old type wrench unless the user additionally buys the aforementioned new type wrench. But, it increases the cost to buy a new wrench, and it is inconvenient for the user who gets used to use a specific wrench or a wrench without being built-in with an angle-detecting function.

SUMMARY OF THE INVENTION

Therefore, one aspect of the present disclosure is to provide a quick-release angle measuring device, which can save an additional cost for a new wrench, and can be installed on a specific commonly used wrench according to user requirements. Therefore, the quick-release angle measuring device is very convenient for users.

According to one embodiment of the aspect of the present disclosure, a quick-release angle measuring device is provided, which is applied to a hand tool. The quick-release angle measuring device includes a body, an angle sensor, a controller, a monitor and a power supply. The body has a quick-release part arranged on the body. The quick-release part is suitable to be detachably connected to the hand tool. The angle sensor is arranged in the body for detecting an angle value of the hand tool. The controller is arranged in the body and is signally connected to the angle sensor for a user to set a factor on the angle value. The monitor is arranged on the body and is signally connected to the controller for displaying the angle value. The power supply is arranged in the body for supplying electric power to the controller, the angle sensor and the monitor.

Furthermore, in other embodiments of the aspect of the present disclosure, the factor may be a critical angle value. In addition, the quick-release angle measuring device may further include a buzzer connected to the controller. When the angle value reaches the aforementioned critical angle value, the buzzer sounds. Additionally, the factor may be an accumulated angle value. Moreover, the factor may be a changed angle value. The quick-release angle measuring device may further include a key assembly, which is arranged on the body and is signally connected to the controller for the user to set the angle value through the key assembly. The quick-release part may be a strap, a Velcro or a spring retaining ring.

Accordingly, in each of the aforementioned embodiments, with the quick-release part, the body can be applied to different wrenches, and any desired location where the quick-release angle measuring device of the present disclosure is disposed can be selected. In addition, the body is set with the controller for a user to operate and set the controller directly. Furthermore, with the power supply, the quick-release angle measuring device of the present disclosure can be independently used on various wrenches without an external electric power, thereby greatly enhancing the use convenience.

DETAILED DESCRIPTION OF THE PREFERRED EMBODIMENT

Figure 1:
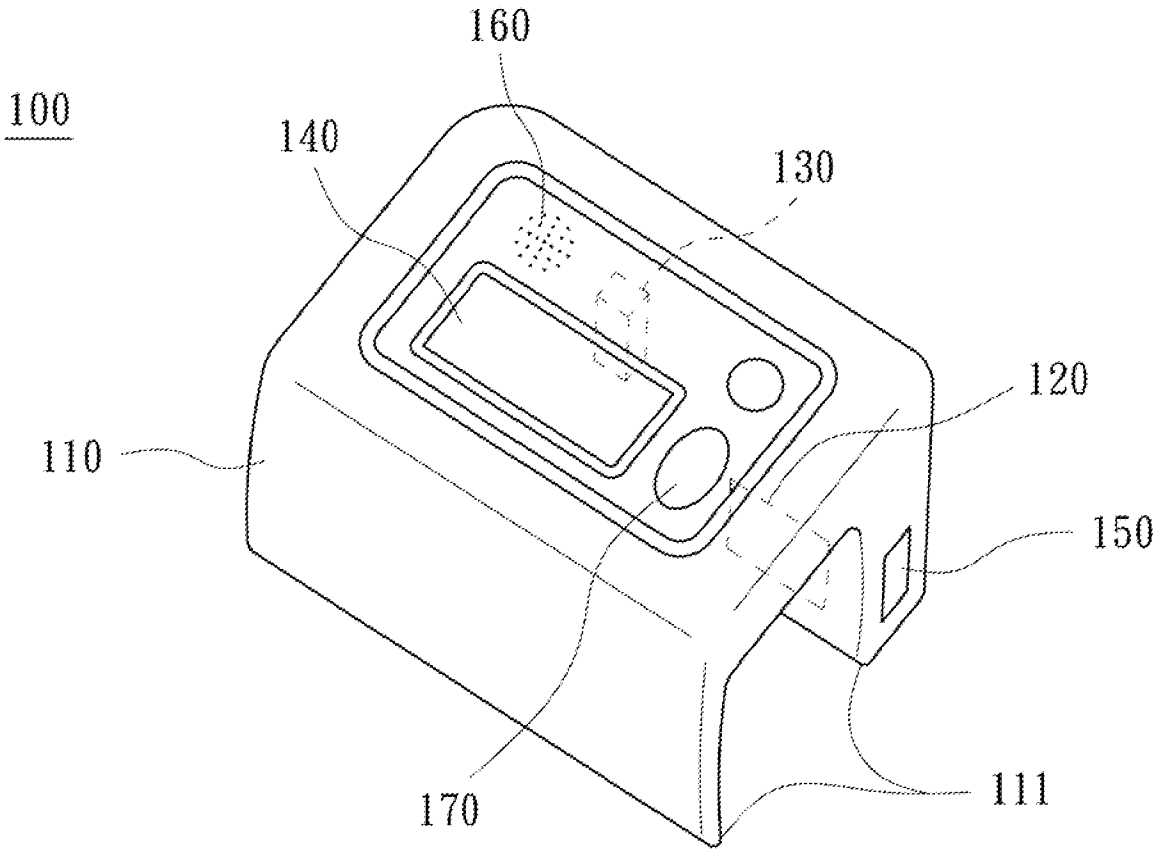
FIG. 1 is a schematic diagram showing a quick-release angle measuring device in accordance with an embodiment of the present disclosure.

FIG. 1 is a schematic diagram showing a quick-release angle measuring device in accordance with an embodiment of the present disclosure. As shown in FIG. 1, a quick-release angle measuring device 100 is applied to a hand tool 101 (referring to FIG. 2). The quick-release angle measuring device 100 includes a body 110, an angle sensor 120, a controller 130, a monitor 140 and a power supply 150.

Figure 2:
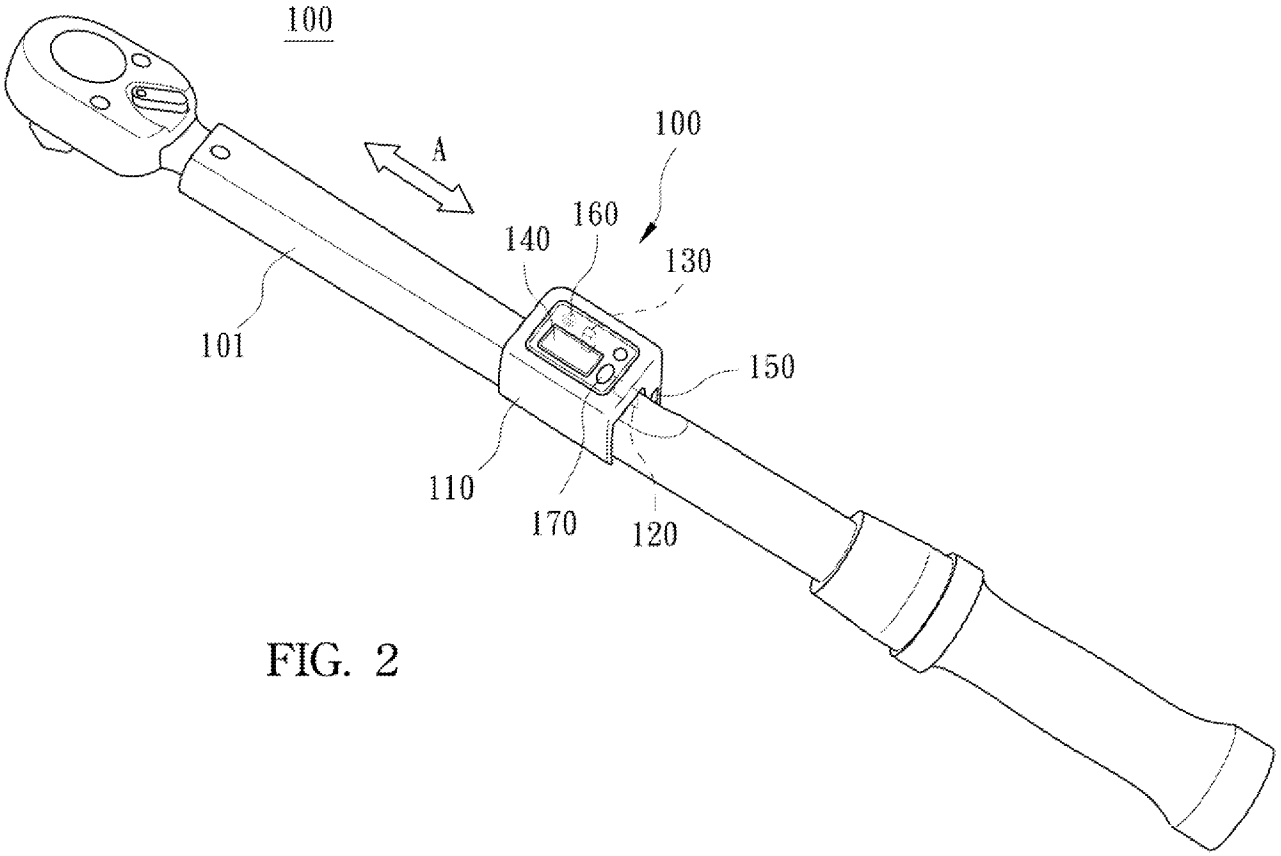
FIG. 2 is a schematic diagram showing a use reference of the quick-release angle measuring device shown in FIG. 1.

FIG. 2 is a schematic diagram showing a use reference of the quick-release angle measuring device shown in FIG. 1. Simultaneously refer to FIG. 1 and FIG. 2. The body 110 has a quick-release part 111 arranged on the body 110. The quick-release part 111 is suitable to be detachably connected to the hand tool. The quick-release part 111 may be a strap, a Velcro or a spring retaining ring. With the quick-release part 111, the body 110 can be suitable for the hand tools with different sizes or functions, and more locations on the hand tool 101 where the body 110 is disposed can be selected. That is the body 110 can be selectively arranged on the locations on the hand tool 101 along an arrow A shown in FIG. 2.

The angle sensor 120 is arranged in the body 110 for detecting an angle value of the hand tool 101. The angle sensor 120 can be disposed on different locations to sense the angle value as the body 110 is arranged on different locations on the hand tool 121 to enhance sensing precision of the angle sensor 120.

The controller 130 is arranged in the body 110 and is signally connected to the angle sensor 120 for a user to set a factor on the angle value. The factor includes many choices, such as a critical angle value, an accumulated angle value, a changed angle value and etc., and the user can set the factor according to his requirement.

The monitor 140 is arranged on the body 110 and is signally connected to the controller 130 for displaying the angle value, so that the user can immediately know the angle value while operating.

The power supply 150 is arranged in the body 110 for supplying electric power to the controller 130, the angle sensor 120 and the monitor 140. In the present embodiment, the power supply 150 is particularly provided, so that the quick-release angle measuring device 100 has an independent power supply, thereby preventing the quick-release angle measuring device 100 from being limited to the hand tool 101 or from needing an external electric power.

Furthermore, in addition to the aforementioned elements, the quick-release angle measuring device 100 of the present embodiment further includes a buzzer 160 and a key assembly 170. The buzzer 160 is connected to the controller 130. When the angle value reaches the aforementioned factor (such as the critical angle value, the accumulated angle value, the changed angle value and etc.), the buzzer 160 sounds to alarm the user.

The key assembly 170 is arranged on the body 110 and is signally connected to the controller 130, so that the user can set the angle value through the key assembly 170. In order to increase the convenience, the present embodiment provides the user with the key assembly 170, so that the user can directly set the controller 130 through the key assembly 170 according to the setting factor of the controller 130.

According to the aforementioned embodiments, it is known that when the quick-release angle measuring device 100 of the present disclosure is used, with the quick-release part 111, the body 110 can be applied to different wrenches 101, and any desired location where the body 110 is arranged can be selected, thereby increasing the sensing precision of the angle sensor 120. In addition, by combining the controller 130 with the key assembly 170, the user can set the controller 130 directly by the key assembly 170, so that it is convenient to use the quick-release angle measuring device 100. Furthermore, with the power supply 150, the quick-release angle measuring device 100 can be independently used on various hand tools without an external electric power, thereby greatly enhancing the use convenience.

As is understood by a person skilled in the art, the foregoing preferred embodiments of the present invention are illustrative of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A quick-release angle measuring device, which is applied to a hand tool, wherein the quick-release angle measuring device includes:

a body having a quick-release part arranged on the body, wherein the quick-release part is suitable to be detachably and directly connected to the hand tool;

an angle sensor arranged in the body for detecting an angle value of the hand tool;

a controller arranged in the body and signally connected to the angle sensor for a user to set a factor on the angle value;

a monitor arranged on the body and signally connected to the controller for displaying the angle value; and a power supply arranged in the body for supplying electric power to the controller, the angle sensor and the monitor.

2. The quick-release angle measuring device according to claim 1, wherein the factor is a critical angle value.

3. The quick-release angle measuring device according to claim 2, further including a buzzer connected to the controller, wherein when the angle value reaches the critical angle value, the buzzer sounds.

4. The quick-release angle measuring device according to claim 1, wherein the factor is an accumulated angle value.

5. The quick-release angle measuring device according to claim 1, wherein the factor is a changed angle value.

6. The quick-release angle measuring device according to claim 1, further including a key assembly arranged on the body and signally connected to the controller for the user to set the angle value through the key assembly.

7. The quick-release angle measuring device according to claim 1, wherein the quick-release part is a strap.

8. The quick-release angle measuring device according to claim 1, wherein the quick-release part is a Velcro.

9. The quick-release angle measuring device according to claim 1, wherein the quick-release part is a spring retaining ring.

* * * * *